US005173011A

United States Patent [19]

Daniel, Jr. et al.

[11] Patent Number: 5,173,011

[45] Date of Patent: Dec. 22, 1992

[54] METHOD AND APPARATUS FOR LEVELING CONCRETE PADS AND SIMILAR HEAVY STRUCTURES

[76] Inventors: Frank J. Daniel, Jr., 2008 Garden Oaks, Arlington, Tex. 76012; Rickey A. Hofmann, 103 Bryson, Midlothian, Tex. 76065; Ralph M. Miller, P.O. Box 115, Poynor, Tex. 75782

[21] Appl. No.: 782,495

[22] Filed: Oct. 25, 1991

[51] Int. Cl.[5] ..... E02D 5/00

[52] U.S. Cl. ..... 405/230; 405/229; 405/303

[58] Field of Search ..... 405/230, 229, 232, 303, 405/196, 198, 200, 236; 254/29 R

[56] References Cited

U.S. PATENT DOCUMENTS

| | | | |
|---|---|---|---|
| 3,902,326 | 9/1975 | Langenbach | 405/230 |
| 4,507,069 | 3/1985 | Murray et al. | 405/230 |
| 4,563,110 | 1/1986 | Langenbach et al. | 405/230 |
| 4,678,373 | 7/1987 | Langenbach | 405/230 |
| 4,711,603 | 12/1987 | Rippe et al. | 405/230 |
| 4,800,700 | 1/1989 | May | 405/230 X |
| 4,907,916 | 3/1990 | Hartman | 405/236 |

*Primary Examiner*—Dennis L. Taylor
*Attorney, Agent, or Firm*—Charles W. McHugh

[57] ABSTRACT

A portable apparatus adapted to be moved to the edge of a concrete pad that needs to be restored to a horizontal condition. The apparatus includes a generally upright frame and a lifting platform that is attachable to the bottom of the frame (with bolts or the like). The platform has a forwardly projecting shelf that is placed under an exposed edge of the pad. A pair of hydraulic cylinders are mounted on the frame for selectively pushing downward on a yoke. Reaction loads from the downward push on the yoke are accommodated by the concrete pad. A chuck is mounted on the yoke for the purpose of engaging a generally linear member that is pushed into the ground to create a deep "foundation" for lifting the concrete pad with respect to the surface. A preferred linear member for this purpose is one or more sections of heavy reinforcing rod of the type that is commonly used to reinforce large concrete structures. A preferred rod is a Number 10 rod having transverse blisters on its surface and a nominal diameter of 1.25 inches. One or more sections are driven vertically into the ground until they reach bedrock, or until the friction forces become so great that the rod is vertically stabilized. Continued pushing on the linear member will cause the concrete pad to be lifted. After the concrete pad has been restored to an elevation that is essentially horizontal, the shelf is rigidly and permanently connected to the linear member.

12 Claims, 4 Drawing Sheets

METHOD AND APPARATUS FOR LEVELING CONCRETE PADS AND SIMILAR HEAVY STRUCTURES

BACKGROUND OF THE INVENTION

This invention relates generally to a portable apparatus that can be selectively moved to the site of a concrete pad of the type that is commonly used to support equipment and structures—including transformers, switching equipment, pumps, generators and similar heavy equipment; more specifically, it relates to an hydraulically operated apparatus that can be utilized to raise an edge of a concrete pad without the necessity of first removing whatever heavy equipment is installed on the pad.

There are many instances in which time and natural forces (including erosion) have an adverse effect on concrete pads (i.e., small slabs) of the type that are widely used to support heavy equipment. Equipment such as transformers, electrical switches, generators, air conditioning compressors, etc., are frequently placed on top of such concrete pads in order to provide stability for the equipment. However, a concrete pad that was installed or poured so as to be level will not necessarily remain level over a period of years. It is common, therefore, to visit a remote piece of equipment and find that soil erosion or repetitive freezing and thawing has caused the supporting soil to have failed in its job of maintaining the slab in a level condition. Because transformers and the like have cooling oil that is designed to maintain the transformers at a desired temperature, anything that causes a transformer to tilt more than a very modest amount can contribute to uneven cooling and perhaps inordinate temperatures that might even cause a transformer to fail. Obviously, then, it would be desirable to restore a concrete pad of the type described herein to a level condition. And if possible, the restoration should be accomplished without taking the transformer out of service or requiring that it be removed from the pad in order to lighten the load that must be lifted.

It is true that lifting devices have been developed and used in other applications. For example, U.S. Pat. No. 4,591,466 to Murray and Bright entitled "Method For Positioning And Stabilizing A Concrete Slab" teaches an apparatus for elevating a portion of a concrete slab when the slab has a hole with a substantial quantity of structurally sound concrete around it. The presence of the structurally sound concrete around the hole is necessary because the Murray and Bright apparatus relies on placing a driving apparatus on top of the slab and using the slab as an anchor to obtaining resisting forces as a series of tubular shafts are driven into the ground under the slab. A similar device is shown in U.S. Pat. No. 4,800,700 to May entitled "Method and Apparatus For Lifting And Supporting Slabs." The May technique involves cutting an elongated hole into a concrete slab and using a special lift plate that is similarly elongated. However, there is no teaching in either of the patents of a technique for approaching the edge of a small slab and pushing directly against the earth instead of pushing against the slab that is to be lifted.

Another device of the prior art is shown in U.S. Pat. No. 4,100,714 to Stith, Jr. entitled "Method Of Positioning And Supporting A Machine." However, the Stith technique requires the presence of an existing concrete foundation against which lifting forces may be exerted in order to lift the edge of a heavy machine by relatively small amounts. In situations where there is no concrete foundation to push against, it would be impossible to utilize a Stith device.

It is also known to elevate the side or corner of a house when a concrete foundation has shifted. But anything that has the size such that it could lift the corner of a house would likely be of such bulk and shape as to require that it be mounted on the rear of a truck or special-purpose vehicle. Regrettably, there is seldom enough room around many transformers and the like to permit a truck to be backed up to a work site. Accordingly, there has remained a need for a portable device that can be handled by two or three men and that has the capacity to lift several hundreds or thousands of pounds. It is an object of this invention to provide such a portable apparatus, and to teach the method of using it to restore concrete pads easily and in a short period of time.

It is a further object to provide an apparatus that can be operated to drive a shaft vertically into the ground even when the terrain around the shaft is not horizontal.

Still another object is to provide an apparatus that is capable of using readily available reinforcing rod as the supporting shaft for a lifting device.

These and other objects will be apparent from a close reading of the specification and claims that follow, together with reference to the several figures of the drawing that are provided herewith.

BRIEF DESCRIPTION OF THE FIGURES OF THE DRAWING

FIG. 12 is a front elevational view of a linear member that has been driven into the ground to a depth to become vertically stable, and showing that any excess length remaining above the lifting platform can simply be cut off with a welding torch or the like;

BRIEF DESCRIPTION OF THE INVENTION

Figure 1:
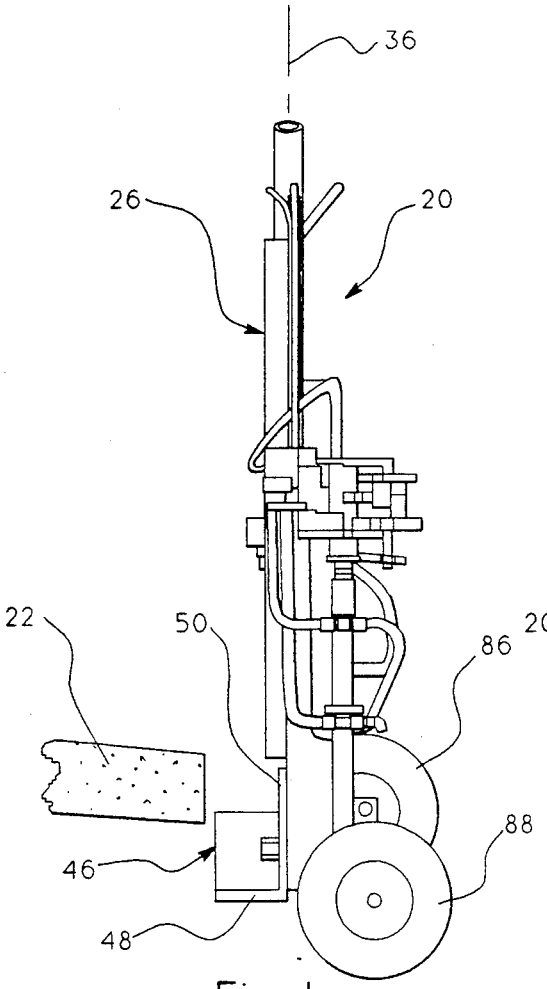
FIG. 1 is a side elevational view of an apparatus in accordance with the invention, with the apparatus being shown adjacent a concrete pad that is to be restored to a level condition.

In brief, the invention includes a portable apparatus that is adapted to be moved to the edge of a concrete pad that needs to be restored to a horizontal condition. The apparatus includes a frame having a generally upright configuration—with a top, a bottom, right and left sides, and a longitudinal axis between the right and left sides. A lifting platform is attachable to the bottom of the frame (with bolts or the like), and includes a forwardly projecting shelf that is adapted to be placed under an exposed edge of the concrete pad that is to be raised. In the preferred embodiment, the shelf constitutes the horizontal leg of an L-shaped platform; and the vertical leg of the L-shaped platform is temporarily bolted to a vertical face in the portable frame.

A pair of hydraulic cylinders are mounted on the frame for selectively pushing downward on a yoke. Reaction loads from the downward push on the yoke are accommodated by the pad and any heavy equipment that is being supported by the pad. A chuck is mounted on the yoke for the purpose of selectively engaging a generally linear member that is to serve as an intermediate "foundation" for lifting the concrete pad with respect to the surrounding ground. A particularly advantageous linear member for this purpose is one or more sections of heavy reinforcing rod, said rods being of the type that are commonly used to reinforce large concrete structures. A preferred rod is a Number 10 rod having transverse (rather than inclined) blisters on its surface; such a rod has a nominal diameter of 1.25 inches. One or more sections are driven into the ground until they reach bedrock, or until the friction forces between the rod and the ground are so great that the rod has become vertically stabilized.

The chuck is preferably operated with pressurized hydraulic fluid, so that it may be operated with the same pressurized fluid that powers the two hydraulic cylinders that push the yoke downward. A source of hydraulic fluid at a pressure of about 2,000 pounds per square inch is preferred. Hydraulic fluid at such a pressure, and at an appropriate volume, is routinely available with earth-moving equipment such as front-end loaders and the like. Alternatively, a portable hydraulic pump that is electrically powered and available from supply houses such as W. E. Granger, Inc. would be serviceable for operation of the apparatus disclosed herein.

It is advantageous to ensure that the linear member is driven into the ground in a vertical manner, even if the surface of the ground adjacent the concrete pad is not horizontal. Hence, it is useful to provide a means for rendering the portable frame horizontal, even when the ground is sloping. This is accomplished by providing two small, hydraulically operated pistons that are respectively associated with the two legs that support the frame with respect to the ground. Selectively pressurizing appropriate ones of these pistons can cause the shelf to be pushed tightly against a lower part of the concrete pad—and also made horizontal. As the linear member is driven into the ground and the shelf is raised, a point will eventually be reached at which the shelf is in full contact with the bottom of the concrete pad.

After the concrete pad has been restored to an elevation that is essentially horizontal, the shelf is rigidly connected to the linear member that has been driven into the ground. Some kind of material is then used to back-fill the cavity that was created when the concrete pad was raised. Such material can help prevent rodents or other small animals from making a home under the pad, and may also be of load-bearing material that helps support the pad. Such a supportive material may be concrete, fill dirt, or a load-bearing rigid plastic that is applied as a foam and allowed to cure so as to be capable of helping to support the pad and preventing it from sinking when the lifting apparatus is removed. An L-shaped lifting member is sacrificed with each concrete pad that is lifted, because—for one thing—it is not economical to try to extract a platform from the fresh supporting material that now is helping to hold the concrete pad horizontal. Additionally, it is desirable to be able to obtain continuing support from the linear member that has been driven deep enough into the ground that it is vertically stable.

In use, a crew of two or three workers may roll an apparatus up to the edge of a concrete pad and have the pad returned to a horizontal condition in usually an hour or two—without removing from service any piece of equipment that is mounted on the concrete pad. Hence, if the equipment on the pad is a transformer that was installed by some electrical utility, customers of the utility need never know that an integral part of their power distribution network had been given a significant repair.

DETAILED DESCRIPTION OF A PREFERRED EMBODIMENT

Figure 2:
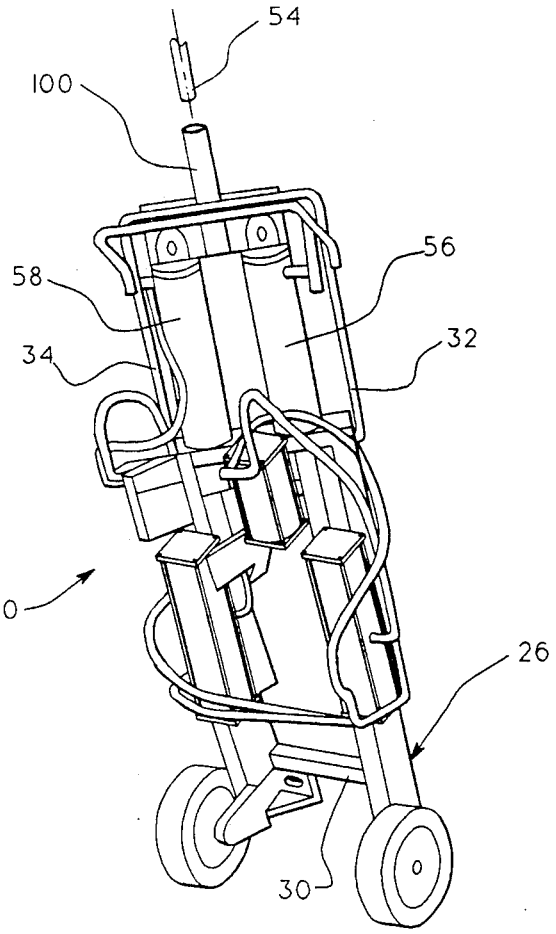
FIG. 2 is a rear elevational view of the apparatus shown in FIG. 1, including a fragmentary showing of a linear element positioned above the apparatus, which is the "loading" position for each of the linear elements that is pushed into the ground by the apparatus.

Referring initially to FIGS. 1 and 2, a portable apparatus 20 is shown in its upright position, such that it is ready to be used for restoring a concrete pad or other heavy object to a horizontal condition. As is common with many installations that are not in a protected building, a concrete pad 22 is frequently used as a foundation to support a transformer, a switch housing, an air conditioner compressor, etc. And when the soil underneath the concrete pad 22 is not stable, the pad has a tendency to sink. And when the pad 22 sinks, it is common (in accordance with Murphy's Law) for it to sink in an uneven manner—such that one edge of the pad is lower than an opposite edge. The pad 22 will then be out of level and in need of being restored to a level or horizontal condition.

The apparatus 20 includes a portable frame 26 having a generally upright configuration—with a top 28, a bottom 30, a right side 32 and a left side 34. A longitudinal axis 36 lies midway between the right and left sides 32, 34 and passes centrally of the frame between the top and bottom thereof. It is along this axis 36 that linear members will be driven into the ground, as will be subsequently described.

Figure 3:
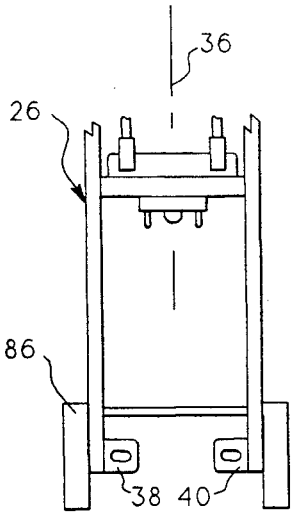
FIG. 3 is a fragmentary front elevational view, showing the lower half of the apparatus before a lifting platform is connected to the frame of the apparatus.
Figure 4:
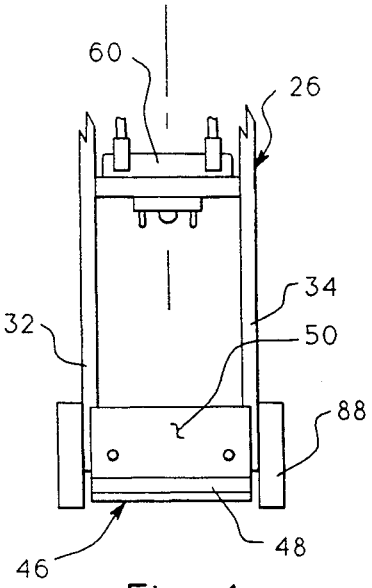
FIG. 4 is a fragmentary view similar to FIG. 3, and showing a lifting platform temporarily bolted to the frame of the apparatus.

Referring additionally to FIGS. 3 and 4, the frame 26 has inwardly protruding elements 38, 40 with apertures 42, 44 therein. The elements 38, 40 protrude from their respective frame members in the manner of ears that extend outwardly from a body, and hence may be conveniently referred to herein as "ears." The function of the ears 38, 40 is to provide a convenient location for attaching a lifting platform 46—which is visible at the bottom of the frame in FIG. 4. The preferred lifting platform 46 has a horizontal element 48 and a vertical element 50, said elements being rigidly connected so as to create a generally L-shaped device when viewed from one side. The horizontal leg 48 protrudes outwardly from the front of the frame 26 for a distance that is sufficient to be positioned under an edge of the concrete slab 22. A preferred distance for the horizontal leg to protrude outwardly from the front of the frame is about four inches. An optimum width for the platform 46 (corresponding to the width of the frame 26) is about 12 to 15 inches. Hence, an area of perhaps 40 to 60 square inches is potentially available for placing the lifting platform 46 into load-bearing contact with the bottom of the pad 22.

The initial function of the platform 46 is not to lift the pad 22 but rather to provide a temporary connection between the frame 26 and the pad, so that the mass of the pad—and any heavy equipment on the pad—may be used in the manner of an anchor or dead weight. By slipping the horizontal leg 48 under an exposed edge of the pad 22, the frame 26 will push upwardly on the pad and be held static as a downwardly directed force is applied to an elongated member 54. This force is obtained by supplying a pressurized fluid to a pair of hydraulic cylinders 56, 58 that are fixed to the top of the frame 26. Suitable hydraulic cylinders 56, 58 are double acting cylinders having a bore of about 3 inches and a rod diameter of about 1.25 inches, and having a nominal operating pressure of 2,000 pounds per square inch. When pressurized to 2,000 psi, each of the cylinders 56, 58 can drive a linear element as described herein into the ground with a force of about 14,000 pounds—as long as there is something to push against. Hence, with this system, all that is required is to provide that some kind of a dead weight to push against. This is routinely accomplished by a man with a shovel or the like, who clears out some soil to expose an edge of the pad 22; the portable frame 26 is then operatively positioned next to the pad adjacent the cleared space. No holes have to be drilled in the pad, and there is no requirement for meticulous and careful alignment of the frame 26 with specific parts of the pad. After an edge of the pad has been lifted by an amount that is necessary to restore the pad to a balanced, level condition, there are no holes in the pad that must be filled, etc., as is the case with techniques like the one disclosed in the aforementioned patents to May and Murray/Bright.

Figure 5:
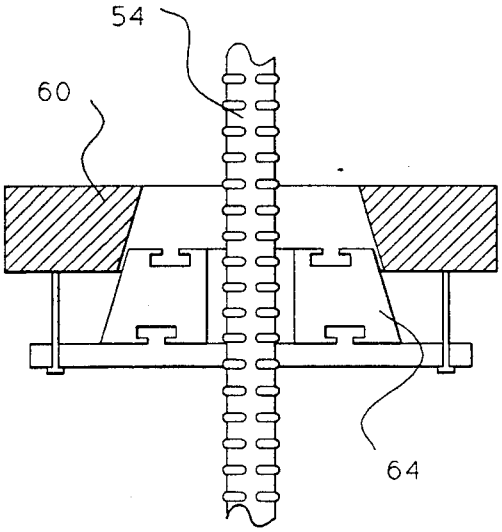
FIG. 5 is a cross-sectioned elevational view of the chuck in its open, non-pressurized mode, with a linear member shown in the position it would occupy before it is grabbed by the chuck.
Figure 6:
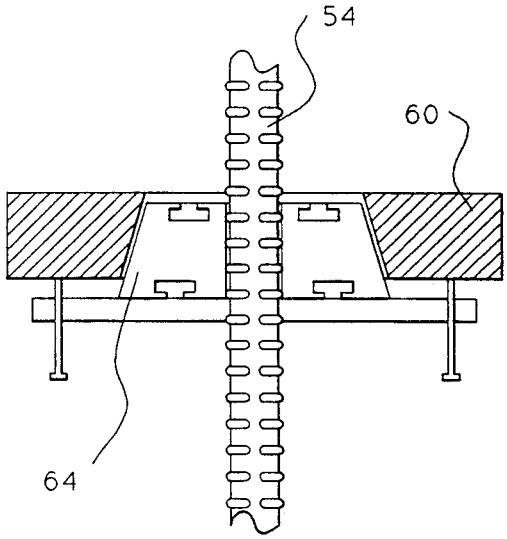
FIG. 6 is a cross-sectioned view similar to FIG. 5, but showing the chuck closed and ready to drive the linear member down into the ground.
Figure 7:
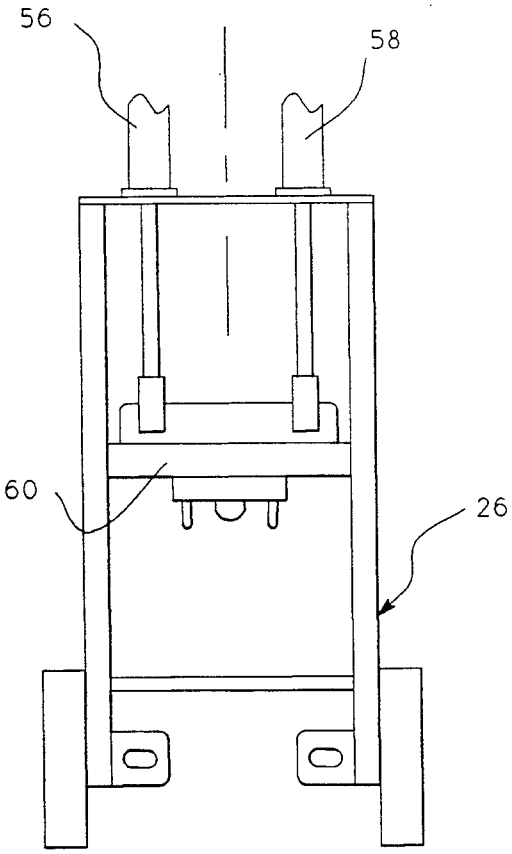
FIG. 7 is a fragmentary view of the chuck and certain other elements after the chuck has been pushed downward by the two hydraulic cylinders.
Figure 8:
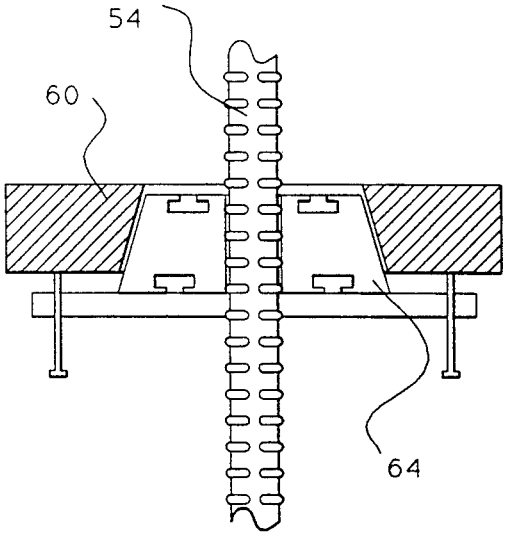
FIG. 8 is a fragmentary view similar to FIG. 7, showing the chuck released and ready to be pulled upward to a level where it can take still another "bite" on the linear member—in anticipation of driving the linear member downward by another increment.
Figure 9:
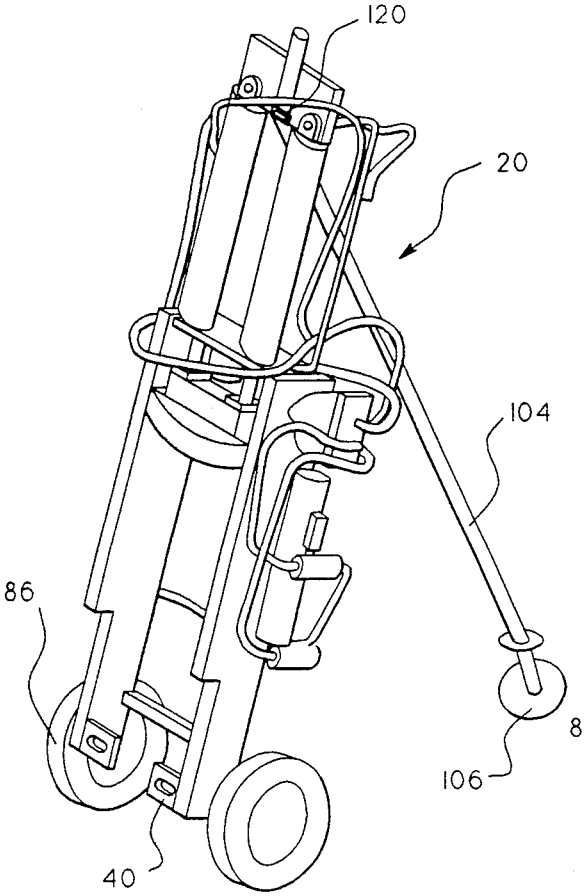
FIG. 9 is a perspective view of an apparatus taken from a generally frontal position, and showing the apparatus with a support arm that fosters mobility of the apparatus.
Figure 10:
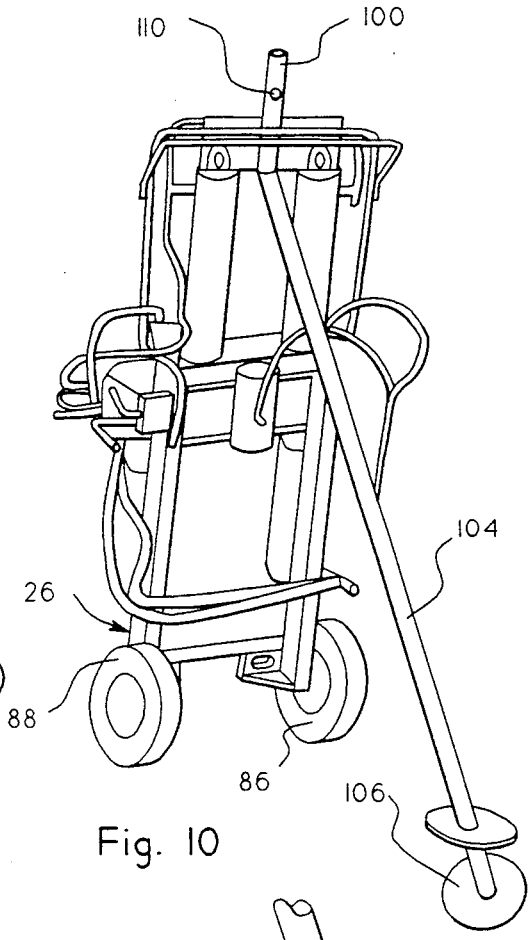
FIG. 10 is a perspective view of the apparatus taken from a generally rearward position, and showing the support arm and a wheel that gives the apparatus a stable, three-point "footprint" for mobility.
Figure 11:
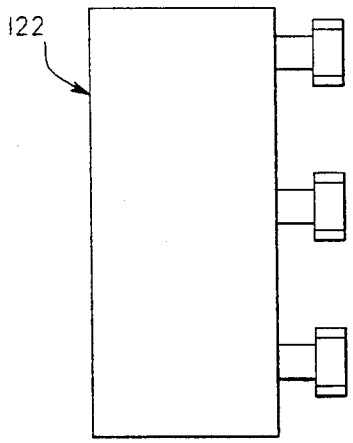
FIG. 11 is a front elevational view of a collar that is affixed to a linear member in order to effect a load-bearing connection between the linear member and a lifting platform, after the linear member has been driven into the ground.
Figure 12:
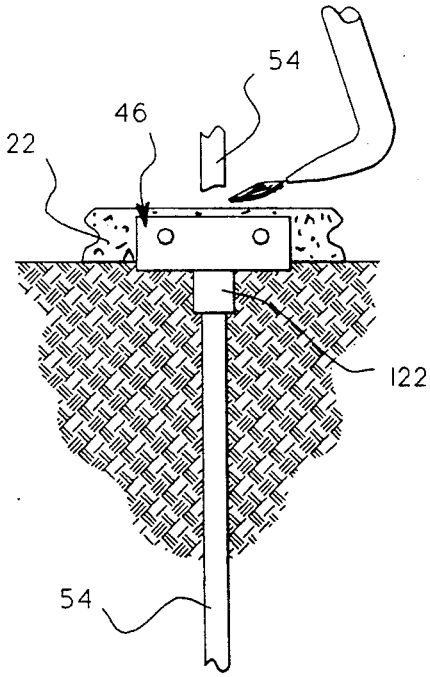

Attached to the distal ends of the rods of cylinders 56, 58 is a yoke 60 that is constrained for generally vertical movement between the frame sides 32, 34. The yoke 60 carries a chuck 64 that is selectively operable to grip and push against a linear member 54—when the two cylinders are pressurized by a source of pressurized hydraulic fluid 70. The chuck 64 has an expanded or open mode in which there is sufficient clearance to easily pass over the surface of a member 54, as well as a closed mode in which the chuck tightly grabs a member. To foster the application of loads to the member 54 when said member is a section of commercially available reinforcing rod, it is advantageous that the member have transversely oriented blisters (or bumps) on its surface—rather than blisters that are inclined with respect to the longitudinal axis of the rod. FIG. 5 shows the chuck 64 in its open mode, and FIG. 6 shows the chuck closed around a linear member 54 and ready to push the member downwardly as the yoke 60 is lowered. FIG. 7 shows the yoke 60 after the cylinders 56, 58 have pushed it downwardly with respect to the frame 26, and FIG. 8 shows the chuck 64 released in preparation for returning the yoke to its raised position.

Figure 13:
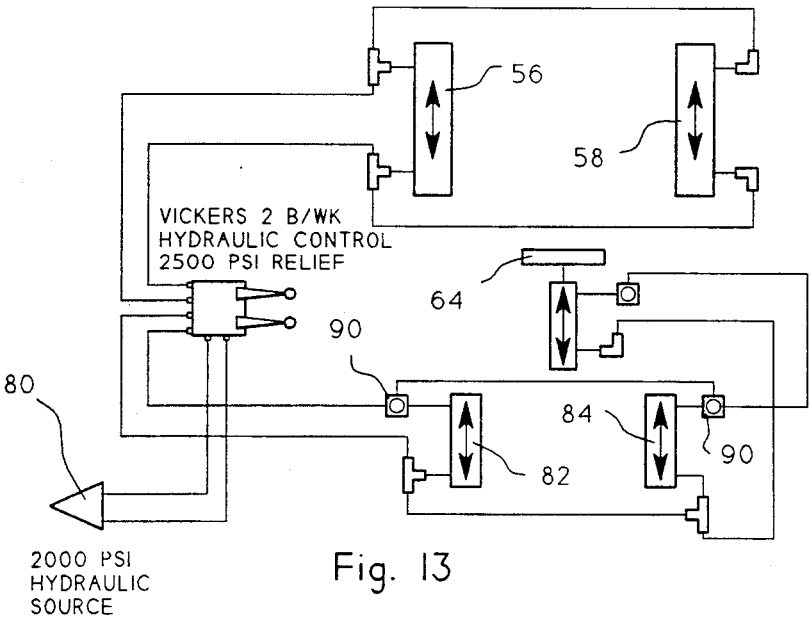
FIG. 13 is a schematic showing of a preferred hydraulic circuit for actuating the several hydraulic cylinders of the apparatus.
Figure 14:
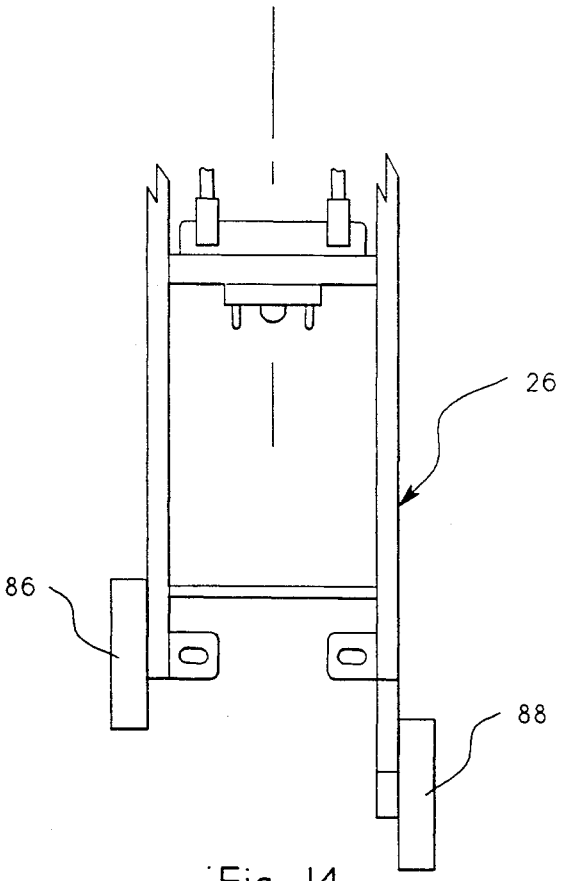
FIG. 14 is a front elevational view showing a preferred embodiment in which the two primary wheels that support the frame are adjustable in height by virtue of connecting the wheels to hydraulic cylinders that are carried by the frame.
Figure 15:
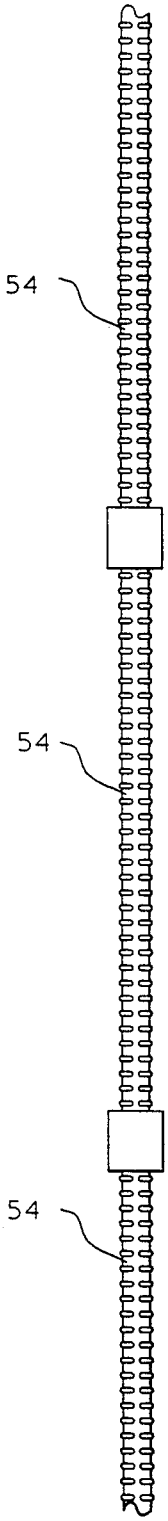
FIG. 15 is a schematic view showing how a serial array of linear elements may be created by placing one of the linear elements on top of another and connecting them with tubular splicing elements.

It is a major consideration for an apparatus 20 as disclosed herein that it be as light as possible, so that a couple of strong men can maneuver the apparatus to a work site and be able to deftly handle it without the risk of injury to themselves or any nearby equipment. To that end, it is advantageous that the same hydraulic system that drives the yoke 60 downward be used, to the extent possible, to give the frame an essentially level orientation before any downward thrust is applied to a linear member 54. This is accomplished by using one or more valves to selectively direct pressurized fluid from a source 80 to the two leveling cylinders 82, 84 that are associated respectively with the two primary wheels 86, 88. A diverter valve 90 is shown in FIG. 13 (a schematic showing of an hydraulic circuit for the apparatus 20) which allows the same on/off control valves to actuate the cylinders 56, 58 or the cylinders 82, 84.

Referring again to FIGS. 2 and 6, there is provided at the top of the frame a generally tubular member 100 that is vertically oriented and lies on the longitudinal axis of the frame 26. The inner diameter of the member 100 is large enough to provide sufficient clearance to accept and guide a linear member 54 downward and through the apparatus as the member is driven into the ground. The throat of the chuck 64 is aligned longitudinally with the member 100 to foster controlled movement of the element 54 as it is pushed downward. Besides being centered with respect to the frame 26—from side to side, the tubular member 100 and the chuck 64 are also centered with respect to the frame from front to rear. This is important whenever the frame 26 is deliberately made as light as possible. That is, when driving forces are applied to a member 54, it would be awkward if such forces generated a torque that tended to tilt the frame 26 backward or forward with respect to the pad 22. Depending upon the weight of the apparatus 20 (typically between 150 and 200 pounds), spacers or the like may be placed—as required—between the front face of the frame 26 and a lifting platform 46, to ensure that the frame will remain vertically upright and stable as a member 54 is pushed into the ground.

Because of the weight of a typical apparatus 20, it may be awkward for a single person to easily handle an apparatus as it is moved over the ground to a work site adjacent a sloping pad 22. Of course, providing two primary wheels at the bottom of the frame 26 permits the frame to be leaned (backward) away from vertical and handled almost as if it were a two-wheel dolly. But it is preferred that a third wheel be available for supporting the frame 26, at least while it is being transported. This is advantageously accomplished by temporarily installing a third wheel on the frame, using the tubular member 100 as an anchor point. A leg 104 has a length such that a frame 26 can be tilted away from vertical for transportation over the ground, and a third wheel 106 is attached to the bottom of the leg. The diameter of the leg 104 is sized so that the top of the leg will fit inside the tubular member 100, and a removable pin 110 is used to connect the top of the leg to the tubular member during transport and storage. The pin 110 prevents the leg from pivoting or twisting with respect to the frame 26, but the third wheel 106 preferably pivots with respect to the bottom of the leg about a generally vertical axis.

In use, the apparatus 20 will typically be brought to a work site in the back of a pickup truck or other lightweight utility vehicle. It will be removed from the bed of the truck by one or two men, and prepared for movement to the site of a slab that is to be leveled. If the distance between the truck and a concrete pad 22 is substantial, it may be useful to attach the leg 104 to the frame 26, to create a triangular-shaped "footprint" that offers increased stability to the frame. After rolling the apparatus 20 to a spot adjacent the pad, a small space beneath the low edge of the pad is cleared (with a shovel or the like) so that the horizontal part of a lifting platform 48 may be fitted under the pad. When an appropriate space has been created, a lifting platform 46 is bolted to the front of the frame 26, and the frame is positioned so that the horizontal leg 48 lies under the pad. The hydraulic system of the apparatus is then connected to a source of pressurized hydraulic fluid, and the apparatus is ready for final adjustment.

The frame 26 is pushed forward until the vertical leg 50 is in contact with the pad 22. If the "horizontal" leg 48 is not level, as determined by a bubble-type level 120 that is mounted about head-high on the frame 26, then the appropriate hydraulic cylinder associated with a support wheel is actuated in order to lower a wheel with respect to the rest of the frame. Once the frame is suitably positioned and oriented, a first linear member 54 is inserted (downwardly) through the open top of the tubular member 110 and allowed to descend through the chuck 64 and a hole in horizontal leg 48. After the rod 54 comes to rest on the ground, the chuck 64 is actuated—to grip the rod 54, and the main cylinders 56, 58 are then actuated to drive the yoke 60 downward with respect to the frame 26. In a preferred embodiment, the piston rods associated with cylinders 56, 58 have a stroke of at least 10 inches, so that the linear rod 54 can be pushed downward into the ground by about 10 inches every time that the cylinders make a full excursion. The speed with which the rod 54 is driven into the ground is ideally about two inches per minute, which is fast enough to make the total job time reasonable but not so fast as to risk harm to the pad 22 (and any equipment on it) if the descending rod 54 should suddenly strike bedrock and the pad should begin to lift with respect to a static rod.

If the first rod 54 should be readily pushed into the ground by the apparatus 20, a second rod would be inserted in the top of the machine in the same manner as the first rod. A collar is secured to the top of the first rod and the bottom of the second rod, to hold the two rods in axial alignment and permit them to be pushed into the ground as a unit. If the ground is particularly soft, it may be necessary to use two, three or even more aligned rods, until such time as bedrock is reached or there is enough friction between the rods and the surrounding earth so that the rods cannot be pushed downward any further. This will be apparent to the operator who is watching the pad 22, because the pad begins to rise when the rods will not go down any further. After the pad 22 has been raised to a desired level, a clamp 122 is placed on the rod 54 immediately below the horizontal leg 48. Such a clamp 122 ideally has a plurality of bolts (e.g., three) that may be tightened against the surface of the rod 54 to effect a rigid connection. Once the horizontal leg 48 is supported by the installed clamp 122, the two bolts that connect vertical leg 50 to the ears 38, 40 may be removed, so that the frame 26 can be removed from its position next to the pad 22. While not mechanically connected to the pad 22, the horizontal leg 48 is effectively rigidly connected to the pad because of the weight of the pad and the fact that the leg cannot be slipped out of its position under the edge of the pad. Any excess of the last rod 54 that sticks up above the horizontal leg 48 is simply cut off with a welding torch or the like, so that there is n no resultant safety obstacle to foot traffic after the frame 26 has been removed.

After the frame 26 has been pulled back away from the now-level pad 22, any cavity under the exposed edge of the pad may be filled with grout, concrete, foamed plastic, fill dirt or anything else that will keep rodents from making a nest under the pad, as well as providing additional support for the pad. Any unused sections of rod 54 are removed from the work site and the apparatus may then be rolled back to the truck. A typical job in restoring a transformer pad to a level condition can be accomplished in two hours or less—without removing the transformer from service.

While only the preferred embodiment of the invention has been disclosed herein in great detail, it will no doubt be apparent to those skilled in the art that modifications could be made without departing from the spirit of the invention. Therefore, it should be understood that the scope of the invention should be measured only by the claims that are attached hereto.

What is claimed is:

1. An apparatus for restoring a concrete pad to a generally horizontal condition without the necessity of removing a load from the pad, said pad having a thickness as measured from its top to its bottom, and having at least one edge that is accessible from the ground adjacent the pad, comprising:

a. a portable frame having a generally upright configuration with a top and a bottom, and having right and left sides and a longitudinal axis therebetween;

b. a lifting platform selectively attachable to the bottom of the frame, said platform having horizontal and vertical legs such that it has a generally L-shaped appearance when viewed from one side thereof, and the horizontal leg protruding outwardly from the front of the frame when the platform is attached to the frame, and said horizontal leg protruding forwardly from the frame for a distance such that it may be inserted under an edge of a pad for a distance sufficient to put it into load-bearing contact with the bottom of the pad;

c. a pair of vertically oriented hydraulic cylinders mounted on the frame, each of said cylinders having a barrel and a rod which moves linearly with respect to its respective barrel;

d. a yoke mounted on the frame and connected to the distal ends of the two rods, such that the yoke will move downward with respect to the frame when the two cylinders are pressurized;

e. a source of pressurized hydraulic fluid connected to the pair of hydraulic cylinders through a valve, such that the hydraulic cylinders may be selectively used to push the yoke downward when the valve is opened;

f. a chuck mounted on the yoke for selectively engaging a generally linear member that is positioned so that it rests near the longitudinal axis of the frame;

g. means associated with the frame for holding a generally linear member centrally of the frame while the generally linear member is being pushed into the ground in a generally vertical manner; and h. means for rigidly connecting the platform to the generally linear member after the pad has been restored to a generally horizontal elevation, whereby the platform may be separated from the frame after the pad has been restored to a desired elevation, and whereby the frame may be removed for use at another location while leaving the pad supported by the generally linear member.

2. The apparatus as claimed in claim 1 and further including a pair of ground-contacting rollers mounted on the bottom of the frame, such that the frame may be manually rolled to a work site immediately adjacent a concrete pad that is to be raised.

3. The apparatus as claimed in claim 2 wherein each of the two ground-contacting wheels is independently adjustable with respect to the frame in a plane that is generally parallel to the longitudinal axis of the frame, whereby the frame may be selectively oriented with respect to the ground adjacent a concrete pad by independently raising or lowering a particular one of the wheels while the frame is in a generally upright mode.

4. The apparatus as claimed in claim 2 and further including a third ground-contacting wheel that is mounted on the frame to foster ease in manually transporting the apparatus over the ground adjacent a pad that is to be raised, and said third wheel is mounted in such a way as to be selectively removable from the frame.

5. The apparatus as claimed in claim 4 wherein the third wheel is located at a point that is remote from a construction line connecting the first two ground-contacting wheels, such that the respective contact points between the ground and the three wheels define a triangle.

6. The apparatus as claimed in claim 1 wherein the chuck is hydraulically operated, and further including a valve for causing the chuck to selectively grip and release the generally linear member.

7. The apparatus as claimed in claim 6 wherein the chuck is plumbed so it operates from the same source of pressurized hydraulic fluid that is used to push the yoke downward with respect to the frame.

8. The apparatus as claimed in claim 1 wherein the lifting platform is selectively attachable to the frame with a pair of widely spaced bolts that lie on opposite sides of the longitudinal axis of the frame.

9. The apparatus as claimed in claim 1 wherein the lifting platform is selectively attachable to the linear member with mechanical means including a plurality of closely spaced bolts that lie in a straight line that is parallel to the longitudinal axis of the frame.

10. The apparatus as claimed in claim 1 and further including a bubble-type level that is permanently attached to the frame in such a way as to cause the bubble to be centered when the longitudinal axis of the frame is vertical.

11. The apparatus as claimed in claim 1 wherein the two hydraulic cylinders each have a bore of about three inches and the rods are about 1.25 inches in diameter, such that each of the cylinders are capable of exerting a driving force of about 14,000 pounds when pressurized with hydraulic fluid at 2,000 psi.

12. The apparatus as claimed in claim 1 wherein each of the two hydraulic cylinders has a rod whose excursion between a fully extended position to a fully retracted retracted is at least ten inches, whereby the apparatus is capable of driving the generally linear member into the ground a distance of about ten inches with each full stroke of a cylinder.

* * * * *